US008672616B2

(12) United States Patent
Bryk et al.

(10) Patent No.: US 8,672,616 B2
(45) Date of Patent: Mar. 18, 2014

(54) GUIDE BLADE CARRIER

(75) Inventors: Roderich Bryk, Düren (DE); Oliver Strohmeier, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 369 days.

(21) Appl. No.: 13/131,346

(22) PCT Filed: Sep. 16, 2009

(86) PCT No.: PCT/EP2009/061996

§ 371 (c)(1),
(2), (4) Date: May 26, 2011

(87) PCT Pub. No.: WO2010/063500

PCT Pub. Date: Jun. 10, 2010

(65) Prior Publication Data

US 2011/0236213 A1 Sep. 29, 2011

(30) Foreign Application Priority Data

Dec. 3, 2008 (EP) ..... 08020992

(51) Int. Cl.
*F01D 25/24* (2006.01)
*F01D 25/26* (2006.01)

(52) U.S. Cl.
USPC ..... 415/138; 415/193; 415/209.1; 415/209.2; 403/28; 403/57; 403/221

(58) Field of Classification Search
USPC ..... 415/134–136, 138, 189–190, 193, 415/209.1, 209.2, 209.3, 209.4, 210.1; 403/28, 53, 57, 220, 221
See application file for complete search history.

(56) References Cited

U.S. PATENT DOCUMENTS

| | | | | |
|---|---|---|---|---|
| 2,445,661 | A | 7/1948 | Constant et al. | |
| 2,934,316 | A | 4/1960 | Watson et al. | |
| 3,625,550 | A * | 12/1971 | Beyeler | 403/221 |
| 4,684,320 | A * | 8/1987 | Kunz | 415/190 |
| 6,302,648 | B1 * | 10/2001 | Konishi et al. | 415/193 |
| 2007/0031247 | A1 | 2/2007 | Spitzer et al. | |

FOREIGN PATENT DOCUMENTS

| | | | |
|---|---|---|---|
| CH | 304835 | A | 1/1955 |
| DE | 190159 | C | 10/1907 |
| GB | 2218167 | A | 11/1989 |

* cited by examiner

*Primary Examiner* — Christopher Verdier

(57) ABSTRACT

A stator blade carrier, particularly for a gas turbine, is provided. The stator blade carrier includes a number of axial segments and is intended to attain a particularly high degree of operational reliability and long service life. To this end, two neighboring axial segments are connected to a number of tie rods, each enclosed by a support tube, wherein a spherical disk is arranged on at least one end of the respective support tube and mounted in a conical socket supported on the respective axial segment.

16 Claims, 3 Drawing Sheets

GUIDE BLADE CARRIER

CROSS REFERENCE TO RELATED APPLICATIONS

This application is the U.S. National Stage of International Application No. PCT/EP2009/061996, filed Sep. 16, 2009 and claims the benefit thereof. The International Application claims the benefits of European Patent Office application No. 08020992.7 EP filed Dec. 3, 2008. All of the applications are incorporated by reference herein in their entirety.

FIELD OF INVENTION

The invention refers to a stator blade carrier, especially for a gas turbine or steam turbine, which consists of a number of axial segments.

BACKGROUND OF INVENTION

Gas turbine or steam turbines are used in many fields for driving generators or driven machines. In this case, the energy content of a fuel or superheated steam is used for producing a rotational movement of a turbine shaft.

To this end, in the gas turbine turbine the fuel is combusted in a combustor, wherein compressed air is supplied from an air compressor. The operating medium, which is produced in the combustor as a result of combustion of the fuel, is directed in this case under high pressure and under high temperature via a turbine unit which is connected downstream to the combustor, where it is expanded, performing work.

For producing the rotational movement of the turbine shaft, in this case a number of rotor blades, which are customarily assembled into blade groups or blade rows, are arranged on this and drive the turbine shaft via an impulse transfer from the operating medium. For flow guiding of the operating medium in the turbine unit, moreover, stator blades, which are connected to the turbine casing and assembled to form stator blade rows, are customarily arranged between adjacent rotor blade rows.

The stator blades in this case are fixed in each case on a stator blade carrier of the turbine unit or compressor unit via a blade root which is also referred to as a platform. Depending upon the design aim of the gas turbine, in this case the stator blades of the gas turbine can be fastened either on a common stator blade carrier, or for each turbine stage or compressor stage provision is made for separate axial segments which are customarily rigidly interconnected. The use of a plurality of axial segments offers the advantage that on the one hand cast parts which are smaller and therefore more favorable to produce are used, and on the other hand the materials of the individual segments can be individually adapted to the physical boundary conditions which prevail in the respective axial region.

In stationary gas turbine turbines, the stator blade carrier is furthermore customarily of conical or cylindrical form and the stator blade carrier, or its individual axial segments, consists, or consist, in each case of an upper and a lower segment which are interconnected via flanges, for example. Axial segments which are axially adjacent to each other can be interconnected in this case via a tie rod connection according to DE 190 159.

In the design of today's gas turbine turbines, in addition to the achievable power, a particularly high efficiency is customarily a design aim. An increase of the efficiency can basically be achieved in this case, for thermodynamic reasons, by an increase of the discharge temperature at which the operating medium flows out of the combustor of the gas turbine turbine and flows into the turbine unit. Therefore, temperatures of about 1200° C. to 1500° C. are aimed at, and also achieved, for such gas turbine turbines.

At such high temperatures of the operating medium, however, the components and parts which are exposed to this are exposed to high thermal loads. In the case of a stator blade carrier which is assembled from a plurality of axial segments, this leads to an axial and radial displacement of the axial segments in relation to each other on account of the current temperature profile and of the variable thermal deformation behavior of the individual axial segments. This leads to a high mechanical load of the connection between the axial segments, which can lead to a rapid material fatigue with resulting cracks or even fractures in the connecting region.

SUMMARY OF INVENTION

The invention is therefore based on the object of disclosing a stator blade carrier which with a particularly high operational reliability achieves a higher service life.

This object is achieved according to the invention by two adjacent axial segments being connected by a number of tie rods which in each case are enclosed by a support tube, wherein a spherical disk, which is mounted in a conical cup which is supported on the respective axial segment, is arranged at at least one end, but preferably at both ends, of the respective support tube.

The invention starts in this case from the consideration that a longer service life of the stator blade carrier would be achievable by avoiding an excessively large mechanical load as a result of variable deformation on account of temperature differences. In this case, a particularly high mechanical load occurs in stator blade carriers which consist of a plurality of axial segments, especially in the connecting region between the individual axial segments. Since this can lead to damage in the case of a rigid connection between two axial segments, the connection should be of a flexible design. A flexible connection can especially be achieved by the axial segments not being connected in a materially-bonding manner, but by being simply clamped to each other in a form-fitting manner. For clamping of the axial segments, provision is made for a number of tie rods. The tie rods in this case can interconnect two adjacent axial segments in a different way, for example by coaxial openings being introduced in each case into the axial segments in question and the tie rod being guided through the openings. On the side of the respective opening facing away from the adjacent axial segment in each case, screw nuts, for example, are then fitted on a thread of the tie rod, which screw nuts have a larger diameter than the respective opening. As a result, the two axial segments are clamped to each other without adopting a materially-bonding connection.

The aim of the arrangement of tie rods between the axial segments of the stator blade carrier is a connection which can absorb the radial or axial displacements as a result of its flexibility without material damage occurring as a result of tension forces or shear forces. A greater flexibility can be achieved by a support tube being clamped between the adjacent axial segments and enclosing the respective tie rod. Such a support tube serves as a spacer between the axial segments or the fixing points of the tie rod, which do not necessarily have to be arranged on the axial edge of the axial segment in each case. As a result of the greater distance between two axial segments, the flexibility of the connection is increased and, even better, damage as a result of mechanical load is avoided. In this respect, displacements of the axial segments in relation to each other are enabled by the support tubes and tie rods.

In order to achieve satisfactory securing of the respective support tube, a spherical disk, which is mounted in a conical cup which is arranged on the respective axial segment, is arranged at one end of the respective support tube. The spherical disk and conical cup then form a ball joint which, however, has an opening for the tie rod which passes through. As a result of this ball joint, radial securing of the support tube is ensured even in the case of an inclination to the normal of the radial surface.

In an advantageous development, in this case the respective tie rod and the respective support tube are of cylindrical design and the inside diameter of the respective support tube is larger than the outside diameter of the respective tie rod. As a result, the flexibility of the connection is increased in the case of a torsion or shearing action of the axial segment in relation to each other since the support tube lies on the side facing the other axial segment in each case, whereas the tie rod is fixed on the side facing away by means of a screw nut, for example. As a result, different fixing points are created in the case of a torsion-induced movement of tie rod or support tube from the normals of the radial surface. As a result of a larger inside diameter of the support tube, support tube and tie rod are constantly spaced apart in all radial directions and so despite different fixing points can be freely inclined to the normal of the radial surface.

In an advantageous development, the number of tie rods is at least six. Particularly in the case of a stator blade carrier which consists of an upper and lower segment, three tie rods can then be provided in each case for each segment of the respective axial segment so that a secure three-point connection of the respective segments of the axial segments ensues.

In a further advantageous development, the respective adjacent axial segments are connected by a universal joint. As a result of such universal joints, an additional cardanic connection of the respective axial segments is achieved, via which a centering and simultaneous transfer of the guiding moment from one to the other carrier are possible, for example if provision is made for only one fixing. As a result, an even more secure connection is achieved with high flexibility at the same time.

A gas turbine- or steam turbine advantageously comprises such a stator blade carrier and also a gas turbine and steam turbine plant comprise a gas turbine- and/or steam turbine with such a stator blade carrier.

One of the advantages which are achieved with the invention is especially that, as a result of the connection of the axial segments of a stator blade carrier by tie rods, a secure and at the same time flexible connection of the axial segments is achieved. As a result, in the case of occurring shear forces or tension forces as a result of variable thermal expansion behavior of the individual axial segments, no damage to the connection occurs and the service life of the stator blade carrier is significantly increased. Therefore, the use of an axially segmented stator blade carrier, which offers further advantages such as smaller components, simpler repairability and the possibility of using different materials for the individual axial segments, is made more attractive.

BRIEF DESCRIPTION OF THE DRAWINGS

An exemplary embodiment of the invention is explained in more detail with reference to a drawing. In the drawing.

Like parts are provided with the same designations in all the figures.

DETAILED DESCRIPTION OF INVENTION

Figure 1:
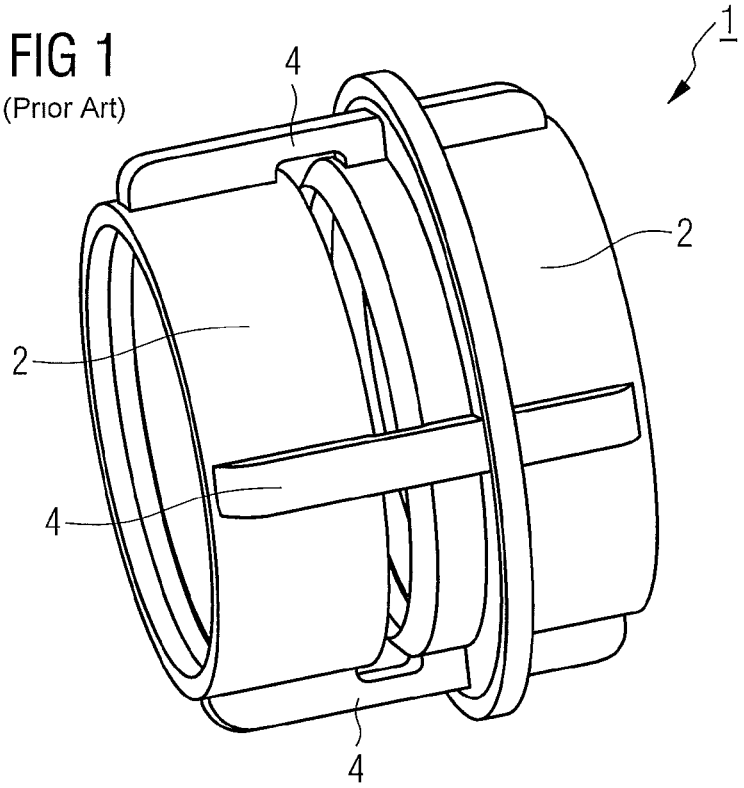
FIG 1 (Prior Art)
FIG. 1 shows two rigidly connected axial segments of a stator blade carrier according to the prior art.

FIG. 1 shows in detail a part of a stator blade carrier 1. In stationary gas turbine turbines, the stator blade carrier 1 is customarily of conical or cylindrical form and consists of two segments, being an upper and a lower segment, which are interconnected via flanges for example.

The depicted stator blade carrier 1 comprises two axial segments 2. In this case, the axial segments 2 are interconnected via connecting bridges 4. As a result, a secure and geometrically stable connection is certainly ensured, but previous operating experience shows that, as a result of the variable thermal deformation of the axial segments 2, high tension forces and shear forces act upon the connecting bridges 4, which can lead to material failure.

Figure 2:
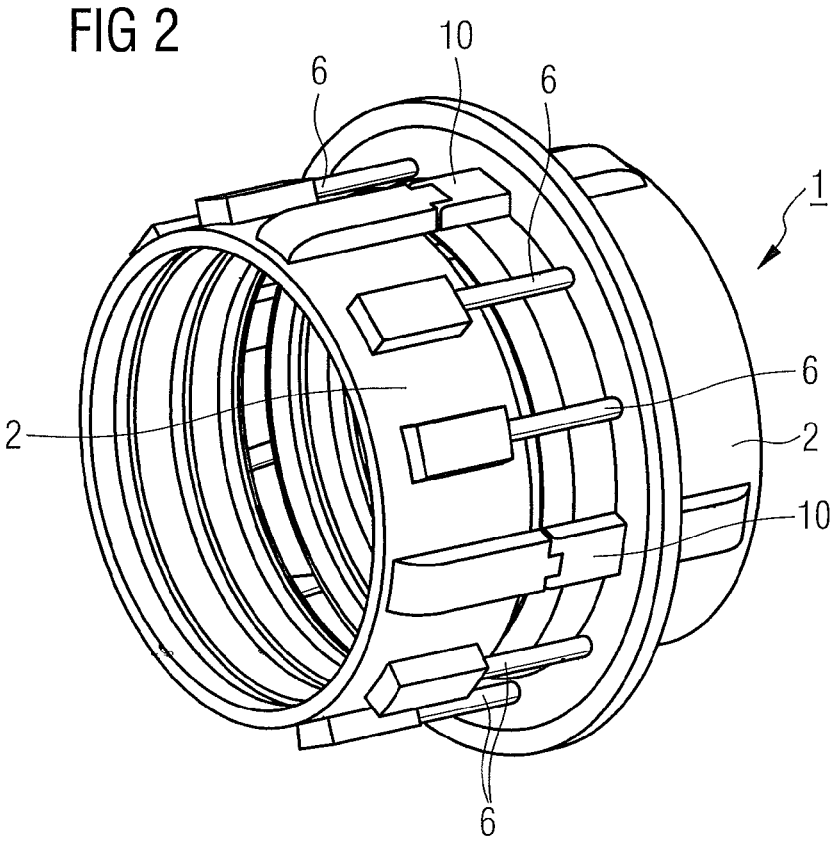
FIG. 2 shows two axial segments, connected via tie rods, of a stator blade carrier.
Figure 3:
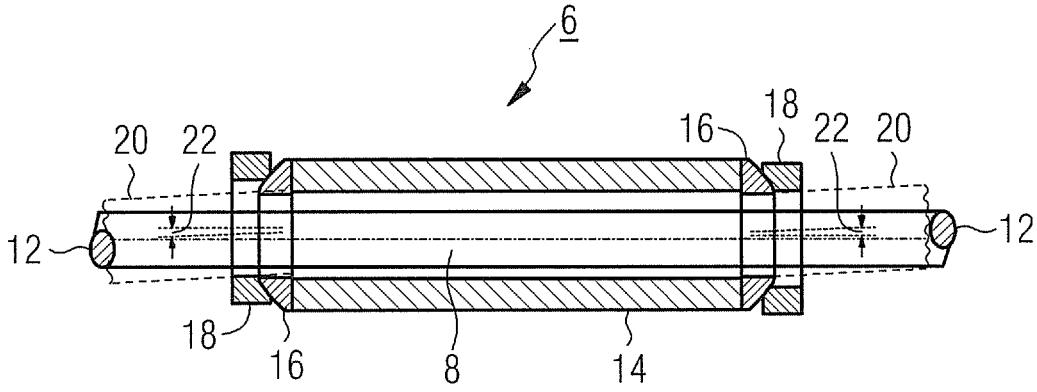
FIG. 3 shows a tie rod with ball-mounted support tube.

For compensation of these tension forces and shear forces, in the stator blade carrier 1 according to FIG. 2 the axial segments 2 are clamped to each other via in this case altogether eight elastic connections 6 with a tie rod 8 in each case (FIG. 3). In addition, provision is made for universal joints 10 which ensure centering of the axial segments 2 and the transfer of shear forces which arise as a result of flow forces which are transmitted from the stator blades to the axial segments.

The construction of each elastic connection 6 is shown in detail in FIG. 3. The central element is the cylindrically solid tie rod 8 which is fastened at its ends 12 on an axial segment 2 in each case. A hollow cylindrical support tube 14 is arranged around the tie rod 8. This acts as a spacer between the axial segments 2. The connection between the axial segments 2 is created via suitable fastening devices on the axial segments 2, which have corresponding openings. The support tube 14 is arranged between the openings on the side facing the other axial segment 2 in each case, after which the tie rod 8 is guided through the openings and support tube 14 and then clamped by screw nuts, for example, on the side which faces away in each case. Therefore, a fixed but not materially-bonding connection is achieved, which within certain limits can be flexibly deformed in the case of tension forces and shear forces.

In order to achieve even better flexibility with simultaneous stability of the connection, spherical disks 16 are attached on the respective axial ends of the support tube 14. These are arranged in correspondingly matching conical cups 18 which are attached in each case on an associated axial segment 2. The spherical disks 16 and conical cups 18 have an opening for the tie rod 8 and ensure a stable retention with simultaneous flexible mounting of the support tube 14 on the axial segments 2.

The distortion is evident in FIG. 3 with the aid of the drawn-in extensions 20 of the axis of the spherical disks 16 in relation to the axis of the tie rod 8. Depending upon thermally induced deformation of the axial segments 2, the angle 22 between the respective axes is variable without the fear of structural damage to the connection in the process. As a result of the spherical mounting, the elastic connection 6 is therefore particularly easily deformable in the case of radial offset and in the case of distortions of the respective regions of the axial segments 2 without losing stability in the process.

Figure 4:
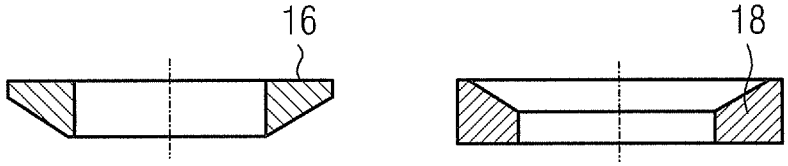
FIG. 4 shows a spherical disk and a conical cup for mounting of the support tubes.

The spherical disks 16 and conical cups 18 are shown once more in FIG. 4. These can be designed according to DIN 6319, for example, and can be adapted in their geometric dimensions and their material to the respective requirements with regard to stability and flexibility of the elastic connection 6.

Figure 5:
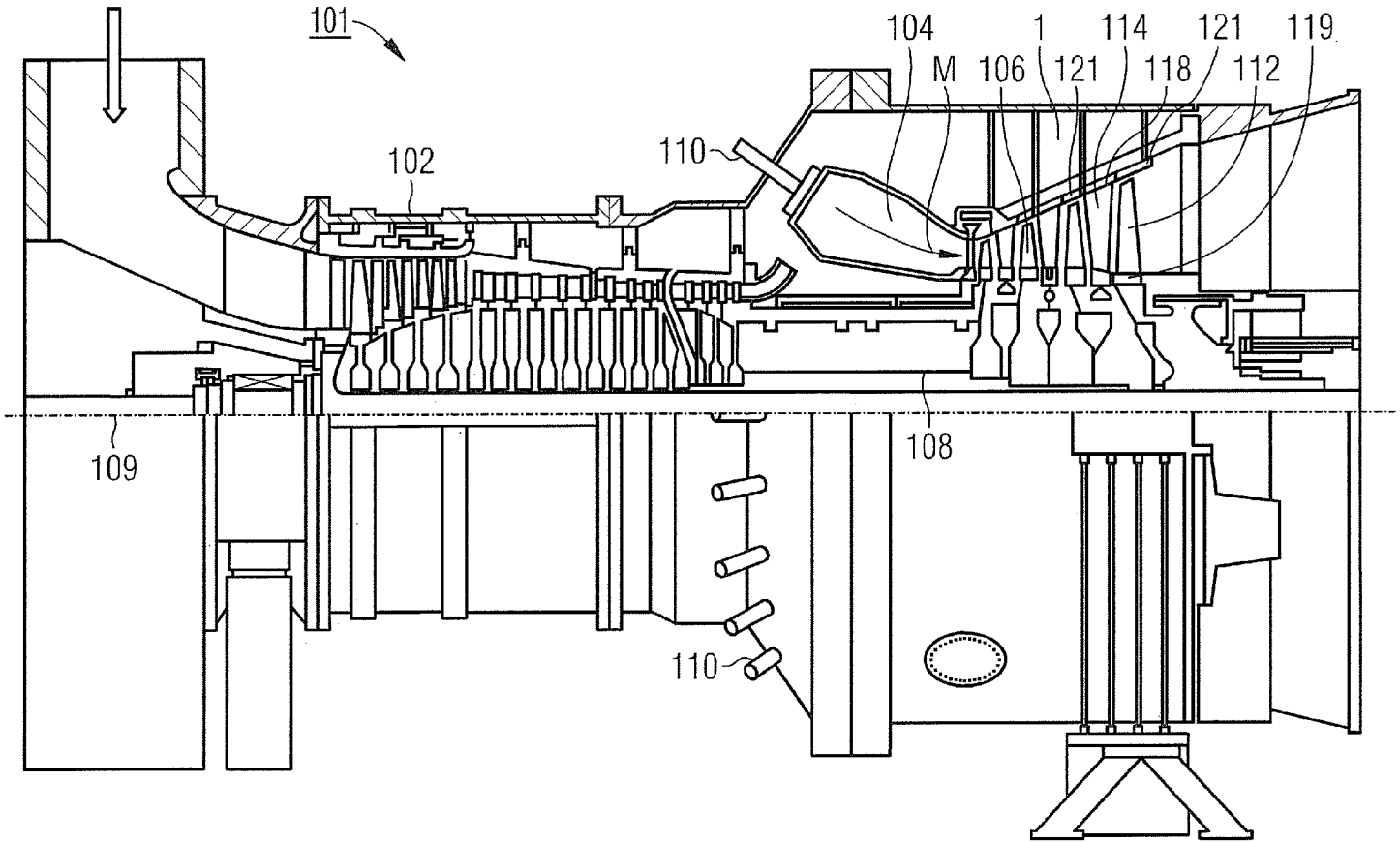
FIG. 5 shows a half-section through a gas turbine turbine.

A stator blade carrier 1 which consists of elastically connected axial segments 2 should be used in a gas turbine turbine, for example. The gas turbine turbine 101 according to FIG. 5 has a compressor 102 for combustion air, a combustor 104 and also a turbine unit 106 for driving the compressor 102 and a generator, which is not shown, or a driven machine. For this, the turbine unit 106 and the compressor 102 are arranged on a common turbine shaft 108, which is also referred to as a turbine rotor, to which the generator or the driven machine is also connected, and which is rotatably mounted around its center axis 109. The combustor 104, which is constructed in the style of an annular combustor, is equipped with a number of burners 110 for combusting a liquid or gas turbineeous fuel.

The turbine unit 106 has a number of rotatable rotor blades 112 which are connected to the turbine shaft 108.

The rotor blades 112 are arranged in a ring-like manner on the turbine shaft 108 and therefore form a number of rotor blade rows. Furthermore, the turbine unit 106 comprises a number of stationary stator blades 114 which are fastened also in a ring-like manner on a stator blade carrier 1 of the turbine unit 106, forming stator blade rows. The rotor blades 112 in this case serve for driving the turbine shaft 108 by impulse transfer from the operating medium M which flows through the turbine unit 106. The stator blades 114, on the other hand, serve for flow guiding of the operating medium M between two consecutive rotor blade rows, or rotor blade rings, in each case, as seen in the flow direction of the operating medium M. A consecutive pair consisting of a ring of stator blades 114, or a stator blade row, and a ring of rotor blades 112, or a rotor blade row, in this case is also referred to as a turbine stage.

Each stator blade 114 has a platform 118 which as a wall element is arranged for the fixing of the respective stator blade 114 on a stator blade carrier 1 of the turbine unit 106. The platform 118 in this case is a thermally comparatively heavily loaded component which forms the outer limit of a hot gas turbine passage for the operating medium M which flows through the turbine unit 106. Each rotor blade 112 is fastened in a similar way on the turbine shaft 108 via a platform 119 which is also referred to as a blade root.

Between the platforms 118—which are arranged at a distance from each other—of the stator blades 114 of two adjacent stator blade rows, a guide ring 121 is arranged in each case on a stator blade carrier 1 of the turbine unit 106. The outer surface of each guide ring 121 in this case is also exposed to the hot operating medium M which flows through the turbine unit 106 and by means of a gap is at a distance in the radial direction from the outer end of the rotor blades 112 which lie opposite it. The guide rings 121 which are arranged between adjacent stator blade rows serve in this case especially as cover elements which protect the inner casing in the stator blade carrier 1, or other installed components in the casing, against thermal overstress as a result of the hot operating medium M which flows through the turbine 106.

The combustor 104 is designed as a so-called annular combustor in the exemplary embodiment, in which a multiplicity of burners 110, which are arranged circumferentially around the turbine shaft 108, open into a common combustion chamber. For this, the combustor 104 is designed in its entirety as an annular structure which is positioned around the turbine shaft 108.

As a result of using a stator blade carrier 1 of the design which is specified above, an increased service life and lower susceptibility of the gas turbine turbine 1 to repair is achieved. As a result of the elastic connections 6, particularly damage to the stator blade carrier 1 as a result of thermal deformations of the axial segments 2 is avoided. In this case, the stator blade carrier 1 can be used either in the compressor 102 or in a steam turbine.

The invention claimed is:

1. A stator blade carrier, comprising:
a plurality of axial segments;
a plurality of tie rods; and
a spherical disk,
wherein two directly adjacent axial segments are connected by a plurality of tie rods which in each case are enclosed by a support tube,
wherein the spherical disk which is mounted in a conical cup and supported on the respective axial segment, is arranged at at least one end of the respective support tube.

2. The stator blade carrier as claimed in claim 1,
wherein the respective tie rod and the respective support tube are of cylindrical design and
wherein an inside diameter of the respective support tube is larger than an outside diameter of the respective tie rod.

3. The stator blade carrier as claimed in claim 1, wherein a number of tie rods is at least six.

4. The stator blade carrier as claimed in claim 1, wherein adjacent axial segments are connected by a universal joint.

5. The stator blade carrier as claimed in claim 1, wherein the stator blade carrier is used in a gas turbine or a steam turbine.

6. The stator blade carrier as claimed in claim 1, wherein the spherical disk is arranged at both ends of the respective support tube.

7. A gas turbine or a steam turbine, comprising:
a stator blade carrier, comprising:
a plurality of axial segments,
a plurality of tie rods, and
a spherical disk,
wherein two directly adjacent axial segments are connected by a plurality of tie rods which in each case are enclosed by a support tube,
wherein the spherical disk which is mounted in a conical cup and supported on the respective axial segment, is arranged at at least one end of the respective support tube.

8. The gas turbine or steam turbine as claimed in claim 7,
wherein the respective tie rod and the respective support tube are of cylindrical design and
wherein an inside diameter of the respective support tube is larger than an outside diameter of the respective tie rod.

9. The gas turbine or steam turbine as claimed in claim 7, wherein a number of tie rods is at least six.

10. The gas turbine or steam turbine as claimed in claim 7, wherein adjacent axial segments are connected by a universal joint.

11. The gas turbine or steam turbine as claimed in claim 7, wherein the spherical disk is arranged at both ends of the respective support tube.

12. A gas turbine and steam turbine plant, comprising:
a gas turbine and/or steam turbine, comprising:
a stator blade carrier, comprising:
a plurality of axial segments, a plurality of tie rods, and a spherical disk, wherein two directly adjacent axial segments are connected by a plurality of tie rods which in each case are enclosed by a support tube, wherein the spherical disk which is mounted in a conical cup and supported on the respective axial segment, is arranged at at least one end of the respective support tube.

13. The plant as claimed in claim 12, wherein the respective tie rod and the respective support tube are of cylindrical design and wherein an inside diameter of the respective support tube is larger than an outside diameter of the respective tie rod.

14. The plant as claimed in claim 12, wherein a number of tie rods is at least six.

15. The plant as claimed in claim 12, wherein adjacent axial segments are connected by a universal joint.

16. The plant as claimed in claim 12, wherein the spherical disk is arranged at both ends of the respective support tube.

* * * * *